US005394925A

United States Patent [19]

Ives

[11] Patent Number: 5,394,925

[45] Date of Patent: Mar. 7, 1995

[54] MULTI-CHANNELED LOUVER

[76] Inventor: Jeffrey J. Ives, 8360 Steeplechase Dr., Palm Beach Gardens, Fla. 33418

[21] Appl. No.: 147,787

[22] Filed: Nov. 4, 1993

[51] Int. Cl.[6] ..... E06B 9/00

[52] U.S. Cl. ..... 160/236; 49/92.1

[58] Field of Search ..... 49/92.1, 74.1; 454/221, 454/224, 278; 160/166.1 V, 166.1 R, 178.1, 236, 900; 403/363, 381, 387

[56] References Cited

U.S. PATENT DOCUMENTS

| | | | |
|---|---|---|---|
| 1,754,559 | 4/1930 | Johnson . | |
| 1,872,652 | 8/1932 | Best . | |
| 2,074,482 | 3/1937 | Martens | 156/17 |
| 2,142,629 | 1/1939 | Clark, Jr. | 156/17 |
| 2,914,122 | 11/1959 | Pinto | 160/89 |
| 3,086,584 | 4/1963 | Houmere | 160/168 |
| 4,049,038 | 9/1977 | Hyman et al. | 160/166 A |
| 4,195,680 | 4/1980 | Hyman et al. | 160/166 A |
| 4,519,435 | 5/1985 | Stier | 160/166 A |
| 4,628,980 | 12/1986 | Le Houillier | 160/166 A |
| 4,773,958 | 9/1988 | Goodman | 156/313 |
| 4,842,036 | 6/1989 | Goodman | 160/166.1 |
| 4,877,077 | 10/1989 | Ebert | 160/236 |
| 4,884,616 | 12/1989 | Setele | 160/236 |
| 4,911,220 | 5/1990 | Hiller | 160/236 |
| 4,930,562 | 6/1990 | Goodman | 160/236 |
| 5,029,413 | 7/1991 | Jovanovic | 49/84 |
| 5,050,662 | 9/1991 | Kellener | 160/168.1 |
| 5,094,286 | 3/1992 | Hansen | 160/236 X |
| 5,141,042 | 8/1992 | Schwaegerle | 160/236 |

FOREIGN PATENT DOCUMENTS

| | | | |
|---|---|---|---|
| 73502 | 10/1992 | Australia | 160/236 |

*Primary Examiner*—Jerry Redman
*Attorney, Agent, or Firm*—Fish & Neave

[57] ABSTRACT

A vertical blind louver is provided in which there are multiple channels for receiving and holding decorative inserts. The ability of the louver to receive and hold a wide variety of inserts in combination allows for the creation of new decorative effects.

16 Claims, 3 Drawing Sheets

MULTI-CHANNELED LOUVER

BACKGROUND OF THE INVENTION

This invention pertains to vertical blinds. More particularly it pertains to louvers that may be used in vertical blind systems. It provides a louver having multiple channels along each longitudinal edge of the louver so that a variety of inserts may be used in combinations to achieve new decorative effects.

Prior art louvers having grooved edges were limited in their decorative effects. For example, U.S. Pat. Nos. 4,049,038 and 4,195,680 to Hyman show grooved louvers. However, those louvers were of opaque material and provided only a single channel along each longitudinal edge of the louver. U.S. Pat. No. 4,628,980 to LeHouillier improved upon those louvers by providing clear edges so that no opaque material of the louver would break up the decorative pattern of the insert. However, those louvers provide only one set of channels for accepting decorative inserts, thus limiting the patterns that could be created. Although one embodiment of the LeHouillier patent shows two sets of channels, those sets are located on opposite sides of the louver to enable the insertion of decorative panels on both faces of the louver. Such louvers do not have multiple channels on the same face of the louver and so do not provide the advantages of the instant invention.

SUMMARY OF THE INVENTION

The louver of this invention includes a body portion and decorative insert holding means along each longitudinal edge of the body. The decorative insert holding means have at least two parallel channels running the length of each longitudinal edge of the body. The holding means may be made of the same opaque material as the body or they may be partially or totally transparent.

The multi-edged louvers of this invention accept multiple decorative inserts. Selection of the inserts from the wide variety of available materials, such as vertical blind fabric, conventional drapery material, film material such as Mylar ®, wallpaper, or even rigid vertical blind slats, allows for a wide variety of decorative effects.

It is an object of this invention to provide a vertical blind louver having multiple decorative insert holding channels along the longitudinal edges of the louver.

It is another object of this invention to provide a louver that will accept inserts that expand and contract at different rates while avoiding warping of the louver.

These and other objects and advantages of the invention will be apparent from the following detailed description of the preferred embodiment of the invention taken in conjunction with the drawings, which illustrate by way of example the principles of the invention.

DETAILED DESCRIPTION OF THE PREFERRED EMBODIMENT

Figure 1:
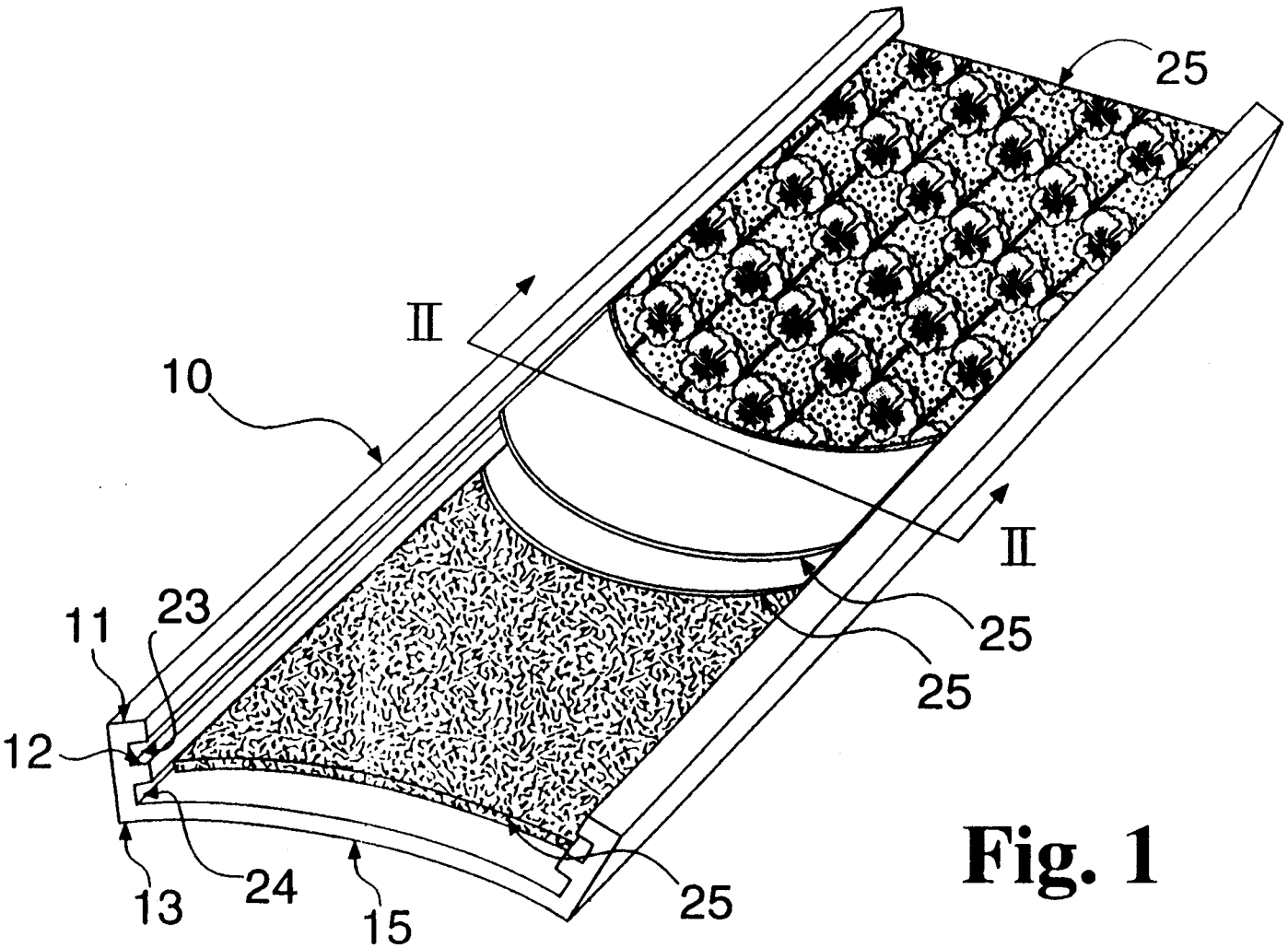
FIG. 1 is a perspective view of the louver of this invention.
Figure 2:
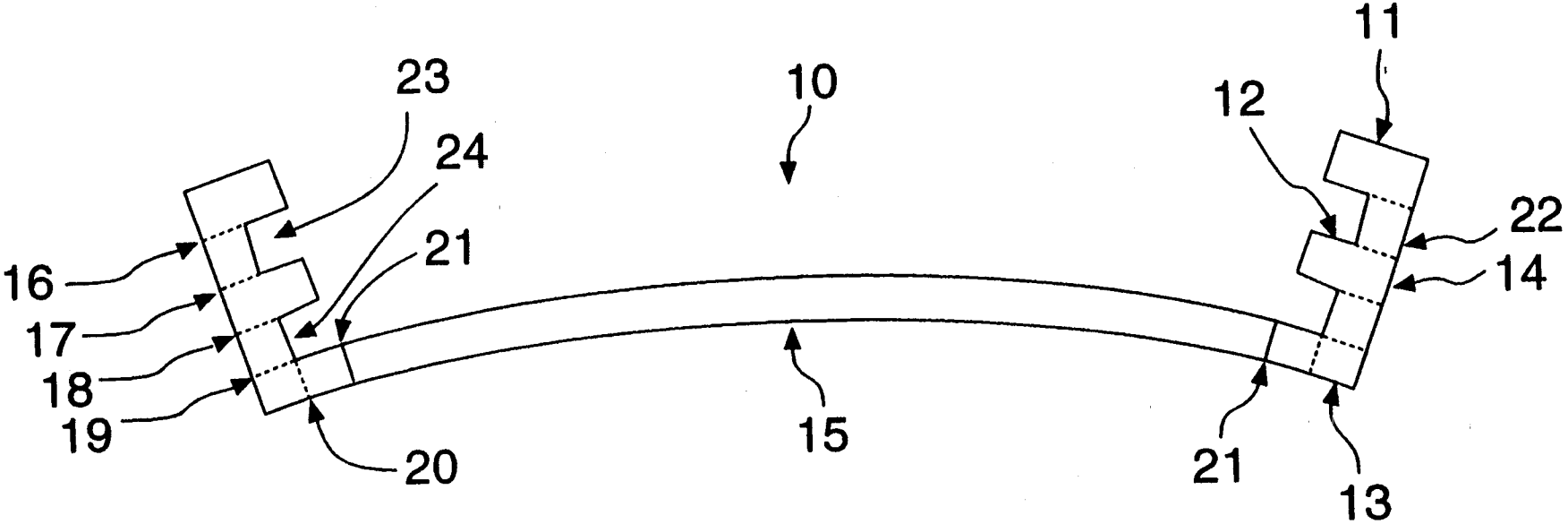
FIG. 2 is a cross sectional view of the louver taken along line II—II.

Louver 10 of this invention is made up of a body portion 15 having a front surface and a rear surface and multi-channeled edges 14 for receiving and holding decorative inserts 25. Body 15 is preferably extruded polyvinylchloride, commonly used in the vertical blind industry, but may be made from any extrudable material or other material suitable for use in the construction of vertical blind louvers. Multi-channeled edges 14 are preferably co-extruded with the body in a single extrusion operation.

Edges 14 may be made in a variety of sizes, shapes and configurations, and may range in appearance from totally opaque to totally transparent. In the totally opaque embodiment, the edges are extruded along with the body 15 in 1he same extrusion operation. Totally or partially transparent edges may be co-extruded in a manner known in the art.

Edges 14 are attached to body 15 along line 21. Each multi-channeled edge 14 has an outer face 11, an inner face 13 and an intermediate face 12. A connecting leg 22 joins outer face 11 to inner face 13. Intermediate face 12 is attached to the connecting leg and extends generally parallel to the outer and inner faces and generally normal to the connecting leg. The space between outer face 11 and intermediate face 12 forms a first insert receiving channel 23. The space between intermediate face 12 and inner face 13 forms a second insert receiving channel 24.

The size of channels 23 and 24 may be adjusted to accommodate decorative inserts 25 of various thicknesses and in various combinations. More than one insert may be held by each channel. For example, two inserts may be held by channel 23 and two other inserts may be held by channel 24.

Figure 3:
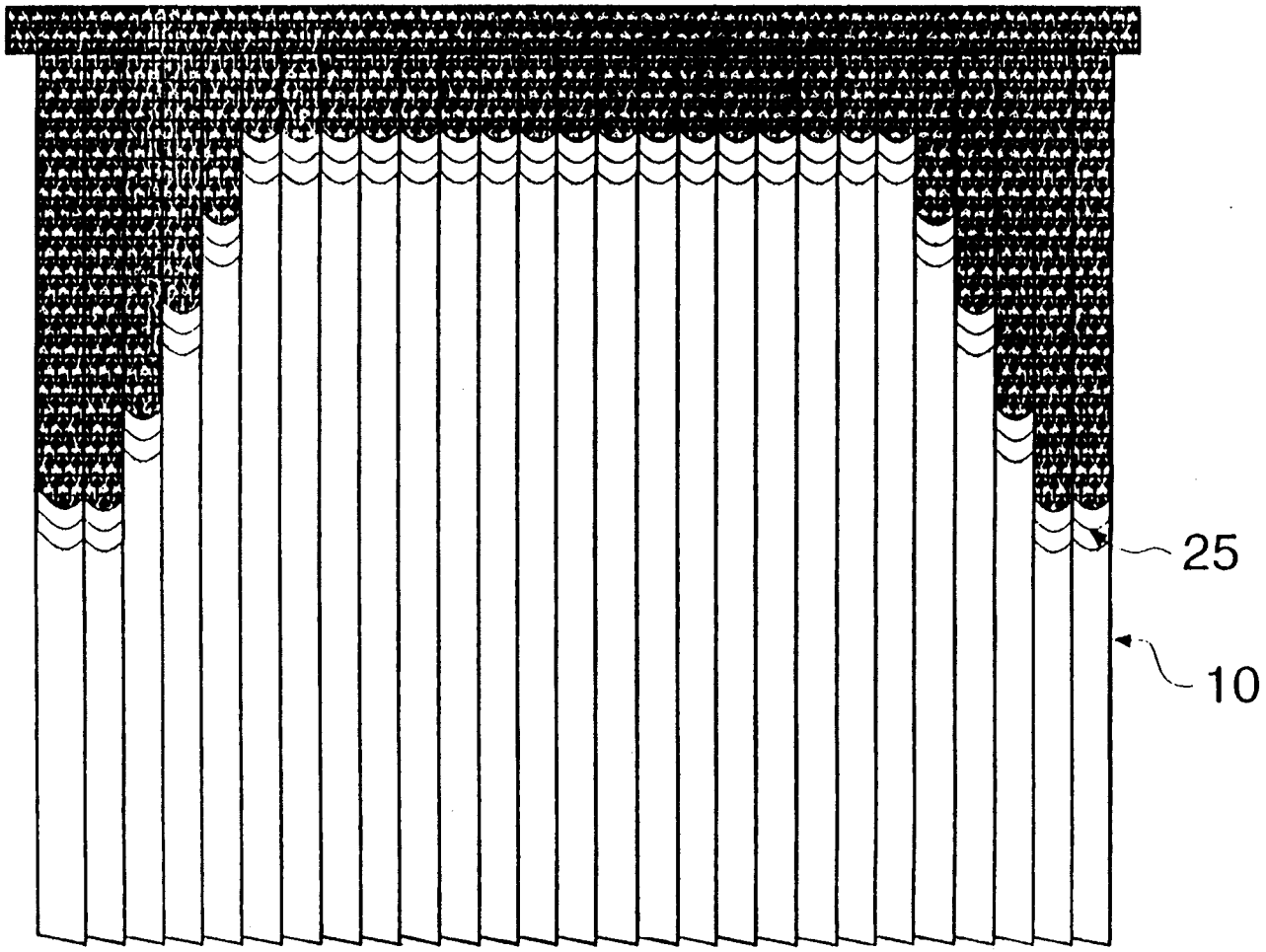
FIG. 3 is a frontal view of a louver system using the louvers of this invention.

The use of multiple inserts allows creation of decorative effects unavailable in the prior art. For example, the swag and jabot appearance illustrated in FIG. 3 is created by two pairs of inserts, with one pair held in each channel. This decorative look combines the attractive features of vertical blinds with the features of swag and jabot drapes. Previously, this effect required a vertical blind system, with all its attendant hardware, as well as a separate drapery rod and material for the swag and jabot, which entailed considerable additional expense and labor. Using the present invention, a similar decorative effect can be achieved more easily and economically by using a single vertical blind system.

Similarly, louver 10 may be constructed with three or more channels, thus allowing even greater flexibility in decorative pattern creation. As with the embodiment having two pairs of insert holding channels, in a louver having three or more channels, decorative inserts 25 may be inserted singly or in multiples to create a desired design.

Yet other decorative effects are readily achievable using this invention. Selection of various textures and thicknesses of inserts 25 can impart a sculptured, three-dimensional look to the window treatment. In another design, one or more of the inserts 25 may have portions, such as the flower designs in FIG. 1, cut out, thus allowing the color of the insert behind to show through.

Moreover, inserts 25 may be located anywhere along the length of louver 10. In that way, various patterns or even logos may be created by an appropriate array and selection of inserts In yet another construction, short lengths of louver 10 may be suspended from a track system and used as holders for pre-existing inserts. That allows for re-use of existing inserts, such as fabric or vertical blind slats, to update a window treatment while minimizing expense.

Alternatively, louver 10 may be full-length and used with pre-existing inserts.

Although prior art grooved louvers may in some instances accept more than one insert in their single groove, such grooved louvers lack the versatility of the present invention, and are less acceptable because problems sometimes arise when such louvers are exposed to heat from sunlight. For example, one of the inserts in such louvers may expand or contract at a rate different from that of the other insert. The common result is warping of the louver, particularly when installed in long lengths, such as for covering a sliding door. With the present invention, different materials are free to expand and contract in their separate channels at their own rates, thus avoiding warping. When installing multiple inserts in each channel, like materials may be paired in a single channel, while differently expanding materials may be inserted in the other channel. Thus, the decorator may combine disparate materials, such as fabrics, films, and even polyvinylchloride slats, all of which expand and contract at different rates, and yet avoid warping of the louver.

An additional advantage flows from the ability of louver 1O to accept multiple inserts 25 in each channel. In that way, standard channel sizes may be manufactured, yet still allow use of inserts of widely varying thicknesses, from thin films to thick polyvinylchloride slats. By pairing or grouping the inserts appropriately, the channels, despite being of standard, fixed sizes, will accept and hold inserts across a broad range of thicknesses.

Face 12, in addition to its role in creating the channels, also provides separation between the inserts. In some constructions, that separation advantageously prevents apparent color reflection or intrusion from one layer of insert to the adjacent insert.

Edges 14 are preferably transparent at least in part. In one embodiment, only the outer face 11 is transparent. The transparent material joins the opaque material at line 16. In this configuration, no opaque material blocks viewing of the outermost insert in channel 23. However, if that insert is itself transparent or translucent, some of the coloring of material behind intermediate face 12 may show through. A variation of this embodiment has the transparent material extending to line 17.

In another embodiment, the transparent material may extend to line 18, thus making both outer face 11 and intermediate face 12 transparent. Alternatively, outer face 11 and intermediate face 12 may be extruded of transparent material, leaving the entirety of connecting leg 22 made of opaque material. Similarly, the transparent material may extend to line 19 or 20, or all the way around the generally E-shaped edge to line 21.

The advantages of the invention extend to the shipping of assembled louvers. Edges 14 preferably run the full length of louver 10 so that, even though the assembled louver may have a far greater thickness of inserts at one end than at the other, edges 14 provide a uniform rail surface throughout the length of louver 10. Thus, when stacked for shipping, a group of louvers 10 will nevertheless lie flat and resist bending or warping.

Although the present invention has been described in detail with reference to various embodiments, it should be understood by those skilled in the art that various modifications can be made without departing from the invention. Accordingly, the invention is limited only by the claims that follow.

I claim:

1. A louver for use in a vertical blind system, comprising:

(a) an elongate, substantially rectangular body having longitudinal edges and a front surface and a rear surface;

(b) the body having holding means along each longitudinal edge;

(c) each such holding means comprising at least two longitudinal channels for engaging and holding inserts, each channel being defined by an inner face coextensive with part of a surface of the body, an intermediate face lying adjacent to the surface of the body defining the inner face, and an outer face lying adjacent the intermediate face and on the same side of the surface of the body defining the inner face as the intermediate face.

2. The louver of claim 1 wherein the holding means comprises a pair of longitudinal channels along each longitudinal edge.

3. The louver of claim 2 wherein the longitudinal channels have a generally E-shaped cross section.

4. The louver of claim 3 wherein the generally E-shaped grooves comprise an outer face lying generally parallel to the body, an inner face attached to the body, a connecting leg between the inner face and the outer face, and an intermediate face attached to and generally normal to the connecting leg and generally parallel to the inner and outer faces.

5. The louver of claim 4 wherein the outer face is substantially transparent.

6. The louver of claim 4 wherein the outer face and at least a portion of the connecting leg are substantially transparent.

7. The louver of claim 4 wherein the outer face, the intermediate face, and at least a portion of the connecting leg are substantially transparent.

8. The louver of claim 4 wherein the outer face, the connecting leg, and at least a portion of the inner face are substantially transparent.

9. The louver of claim 4 wherein the generally E-shaped channels are substantially transparent.

10. The louver of claim 4 wherein the intermediate face is located generally midway between the outer face and the inner face.

11. A louver for use in a vertical blind system, comprising:

(a) an elongate, substantially rectangular body having longitudinal edges and a front surface and a rear surface;

(b) generally E-shaped insert holding means along each longitudinal edge;

(c) the holding means comprising an outer face generally parallel to the body and overlying a portion of the body, an inner face attached to the body, a connecting leg connecting the outer face to the inner face, and an intermediate face located between and generally parallel to the inner face and the outer face and generally normal to the connecting leg and the outer face and the intermediate face both lying adjacent to the same surface of the body.

12. The louver of claim 11 wherein the outer face is substantially transparent.

13. The louver of claim 11 wherein the outer face and at least a portion of the connecting leg are substantially transparent.

14. The louver of claim 11 wherein the outer face, the intermediate face, and at least a portion of the connecting leg are substantially transparent.

15. The louver of claim 11 wherein the outer face, the connecting leg, and at least a portion of the inner face are substantially transparent.

16. The louver of claim 11 wherein the generally E-shaped holding means are substantially transparent.

* * * * *